US005873270A

United States Patent [19]

Scholl

[11] Patent Number: 5,873,270

[45] Date of Patent: Feb. 23, 1999

[54] TEXTILE WET PROCESSING MACHINE HAVING AN ADJUSTABLE INNER WALL

[75] Inventor: Marc D. Scholl, Elon College, N.C.

[73] Assignee: Scholl America, Inc., Gibsonville, N.C.

[21] Appl. No.: 792,645

[22] Filed: Jan. 31, 1997

[51] Int. Cl.[6] ..... D06B 3/26

[52] U.S. Cl. ..... 68/178

[58] Field of Search ..... 68/177, 178; 26/21

[56] References Cited

U.S. PATENT DOCUMENTS

| | | | |
|---|---|---|---|
| 1,209,880 | 12/1916 | Palmer . | |
| 1,531,788 | 3/1925 | Jefferson . | |
| 2,503,817 | 4/1950 | Graham | 68/178 |
| 3,921,420 | 11/1975 | Aurich et al. | 68/5 C |
| 3,949,575 | 4/1976 | Turner et al. | 68/5 C |
| 4,001,945 | 1/1977 | Aurich et al. | 34/155 |
| 4,007,517 | 2/1977 | Turner et al. | 26/18.5 |
| 4,114,407 | 9/1978 | Turner et al. | 68/178 |
| 4,318,286 | 3/1982 | Sturkey | 68/178 |
| 4,340,986 | 7/1982 | Sturkey | 8/152 |
| 4,419,871 | 12/1983 | Zonco et al. | 68/177 X |
| 5,014,526 | 5/1991 | Hacker et al. | 68/178 |
| 5,577,282 | 11/1996 | Turner et al. | 8/152 |

FOREIGN PATENT DOCUMENTS

| | | | |
|---|---|---|---|
| 21591 | 8/1909 | Germany | 26/21 |
| 29 45 942 A1 | 5/1981 | Germany . | |
| 576088 | 4/1958 | Italy | 68/177 |
| 20545 | 9/1984 | United Kingdom | 26/21 |

*Primary Examiner*—Philip R. Coe
*Attorney, Agent, or Firm*—Dougherty & Dremann

[57] ABSTRACT

A textile wet processing machine includes a processing chamber having an adjustable inner wall. The inner wall is adjustable to accommodate textile fabrics in cloth rope form having great variations in weight, texture, thickness, flexibility and load. The inner wall may be positioned at any position between a predetermined innermost position and a predetermined outermost position relative to the outer wall of the processing chamber. In a preferred embodiment, adjustment is accomplished by a pinion that is linearly movable on a rack. A connecting rod extends outwardly from the pinion. One end of the connecting rod is rotatably secured to the transverse shaft of the pinion and the other end of the connecting rod is secured to the inner wall. In an alternative embodiment, adjustment is accomplished by a linkage assembly that is rotatable about a transverse shaft. The linkage assembly includes a first rigid link that is fixed to and extends outwardly from the transverse shaft, and a second rigid link rotatably secured to the free end of the first rigid link at one end. The other end of the second rigid link is secured to the inner wall. A locking mechanism is provided for releasably retaining the inner wall in the desired position under the force of the cloth rope as it is circulated through the processing chamber.

10 Claims, 4 Drawing Sheets

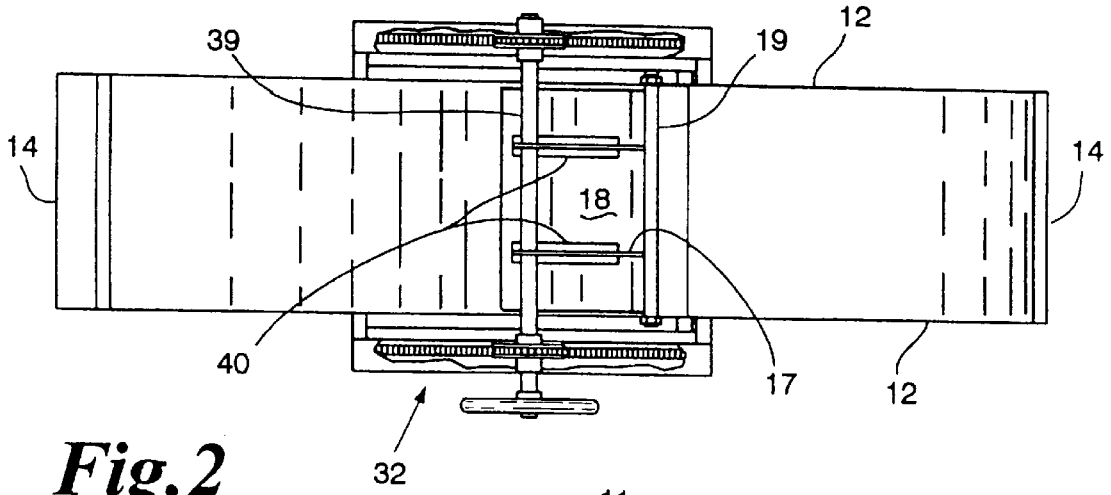
Fig.2
Fig.1
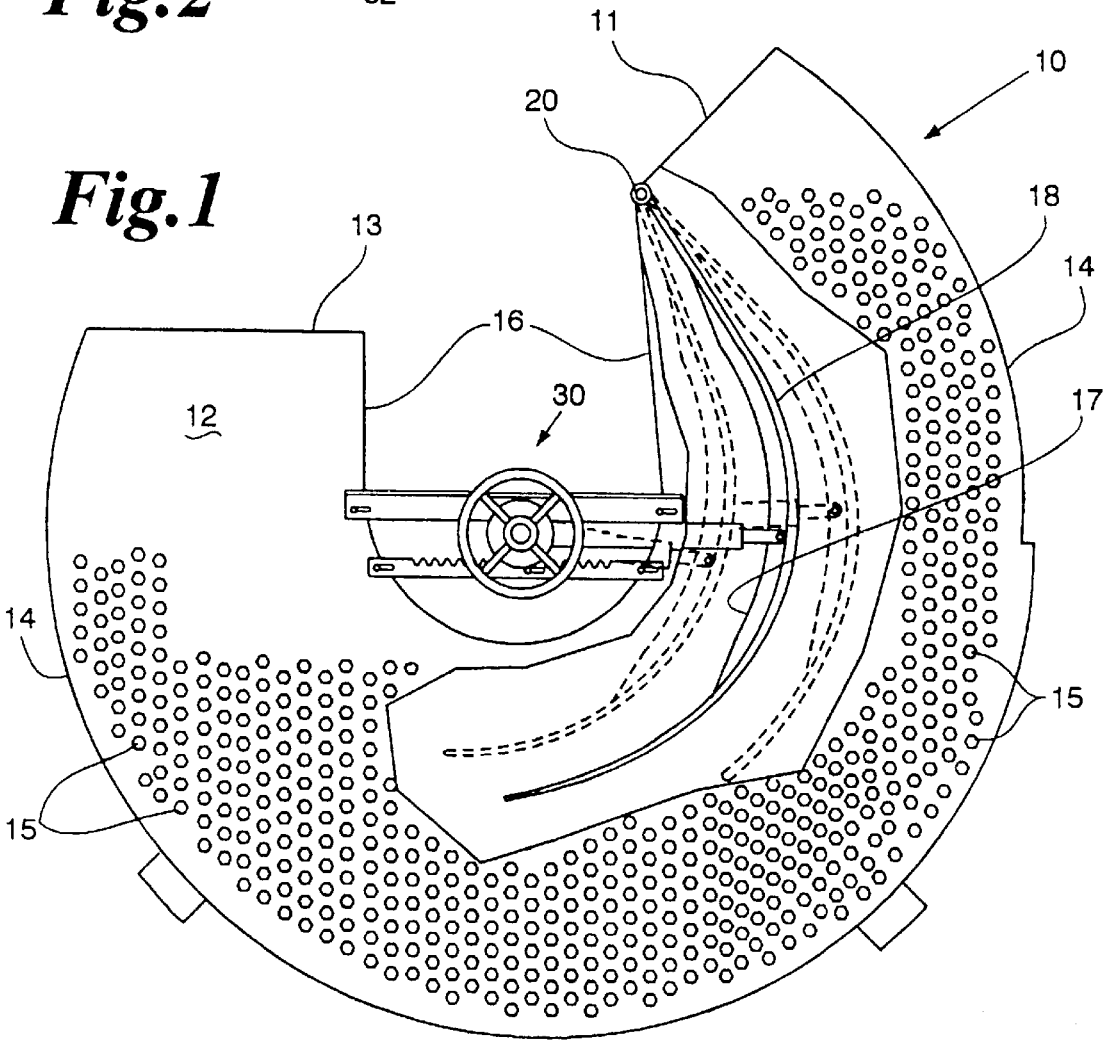

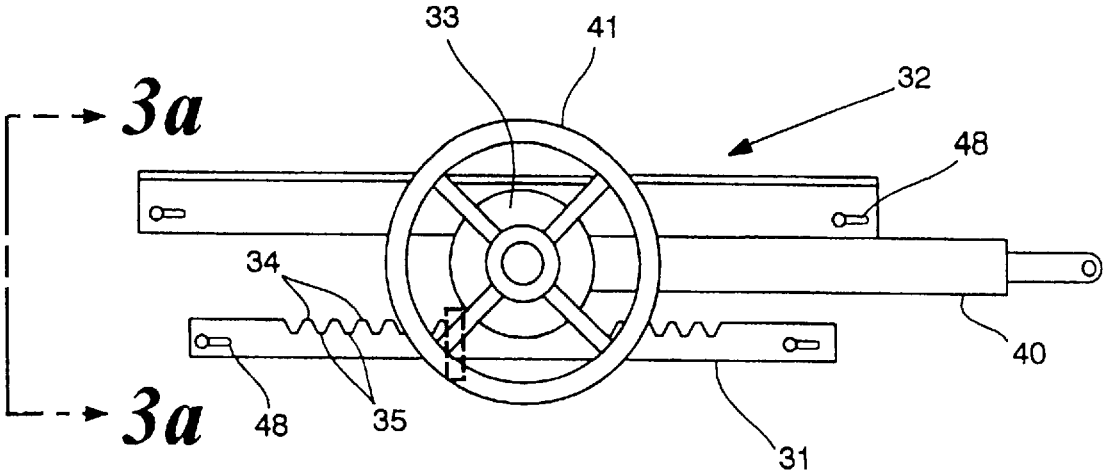
Fig.3
Fig.3a
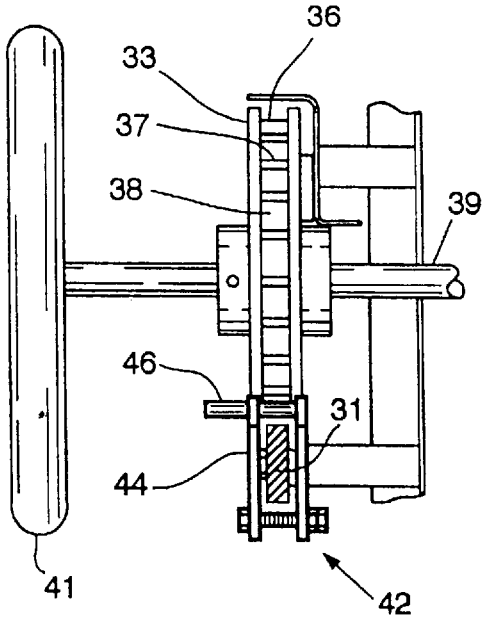

TEXTILE WET PROCESSING MACHINE HAVING AN ADJUSTABLE INNER WALL

FIELD OF THE INVENTION

The present invention relates generally to an apparatus for wet processing textile fabrics in cloth rope form. More particularly, the invention is a textile wet processing machine including a processing chamber having an adjustable inner wall to accommodate textile fabrics in cloth rope form having great variations in weight, texture, thickness, flexibility and load.

BACKGROUND OF THE INVENTION

Textile wet processing machines are utilized extensively in the textile industry. The term "wet processing" refers to the process of treating the textile fabric with a treatment liquid, such as a liquid dye solution. In a particular application, the wet processing machine is used to perform what is known as "piece dyeing" of large textile fabrics. The fabric is formed in a continuous ring that has the appearance of a thick rope. Thus, the term "continuous cloth rope" or "cloth rope" is used to describe the textile fabric. The cloth rope is inserted into the wet processing machine and circulated through a processing chamber containing a liquid dye solution. As the cloth rope is circulated through the processing chamber, it is in the form of a plug referred to as a "cloth plug." As will be described hereafter, the cloth plug is repeatedly circulated through the processing chamber so that the liquid dye solution is dispersed uniformly throughout the textile fabric.

Known textile wet processing machines typically consist of three primary components. The first component is a large vessel for containing the treatment liquid. The vessel includes means for circulating the treatment liquid, and means for heating and cooling the treatment liquid. The vessel contains, without leakage, all of the treatment liquid used to treat the textile fabric. The second component is a U-shaped processing chamber having open ends. The processing chamber is positioned within the interior of the vessel and is typically formed of a pair of side walls, an outer wall extending transversely between the side walls, and an inner wall extending transversely between the side walls opposite the outer wall. The side walls, outer wall, and inner walls of the processing chamber typically have perforations therethrough to allow the treatment liquid to flow into and out of the processing chamber inside the vessel. The third component is a mechanical means, preferably located near the top of the vessel, for drawing the cloth rope out of the processing chamber so that the cloth rope is repeatedly circulated through the treatment liquid in the processing chamber.

The primary problem with the known textile wet processing machines is that they do not adequately accommodate different textile fabrics having great variations in weight, texture, thickness, flexibility and load. These variations are naturally exaggerated when the textile fabric is circulated in cloth rope form through a treatment liquid, such as a liquid dye solution. As is understood by those skilled in the art, the handling characteristics of the textile fabric are dramatically influenced by these variations. Accordingly, textile fabrics having great variations in the properties mentioned herein behave very differently in the wet processing machine and typically require a processing chamber of differing volumetric size to enable the machine to realize its maximum capacity for treating a particular textile fabric.

Those skilled in the art of dyeing textile fabrics in cloth rope form realize that textile wet processing machines having processing chambers of fixed volumetric size cannot accommodate textile fabrics having great variations in weight, texture, thickness, flexibility and load. Dyeing machines manufactured to accommodate heavier or larger diameter cloth rope, cannot also accommodate lighter or smaller diameter cloth rope. If a lighter or smaller diameter cloth rope is circulated through a processing chamber designed to accommodate a heavier or larger diameter cloth rope, the lighter or smaller diameter cloth rope is likely to tangle inside the processing chamber. Likewise, dyeing machines manufactured to accommodate a larger load (i.e., greater length) of cloth rope, cannot also accommodate a smaller load of cloth rope. Similarly, if a smaller load of cloth rope is circulated through a processing chamber designed to accommodate a larger load of cloth rope, the smaller load of cloth rope is likely to tangle inside the processing chamber of the dyeing machine.

In the past, manufactures of textile wet processing machines have responded to the above described problem by manufacturing machines of many different sizes to accommodate the wide range of handling characteristics created by the great variations in fabric weight, texture, thickness, flexibility and load. These machines have included proportionally sized processing chambers having fixed side, outer and inner walls. More recently, a certain manufacture has developed a textile wet processing machine which includes a processing chamber having an adjustable inner wall.

U.S. Pat. No. 5,014,526 issued May 14, 1991, to Hacker et al. discloses a textile wet processing machine including a U-shaped fabric processing chamber with an adjustable inner wall. The inner wall includes C-shaped lateral flanges that permit the inner wall to be removably mounted between the side walls of the processing chamber. The inner wall is mounted to the side walls by a plurality of fasteners that are received in perforations pre-formed in the side walls. Because the inner wall may be repositioned by receiving the plurality of fasteners in different perforations in the side walls, the inner wall is selectively adjustable toward and away from the outer wall. Thus, the volumetric size of the interior of the processing chamber may be changed to accommodate the particular textile fabric being processed.

Disadvantageously, however, the adjustability of the inner wall of the wet processing machine disclosed in the patent to Hacker et al. is limited by the distance in the direction of movement of the inner wall toward or away from the outer wall between the centers of adjacent perforations in the side walls. Thus, the position of the inner wall relative to the outer wall is selectively adjustable to only predetermined, discrete positions. Accordingly, the volumetric size of the interior of the processing chamber cannot be changed in small enough increments to accommodate textile fabrics in cloth rope form having the great variations in weight, texture, thickness, flexibility and load that are typically encountered in the wet processing of textile fabrics.

In addition, the design of the wet processing machine disclosed in the patent to Hacker et al. requires the operator to position himself uncomfortably within the interior portion of the U-shaped processing chamber to remove and replace the plurality of fasteners that selectively reposition the inner wall relative to the outer wall. Thus, each of the plurality of fasteners must first be aligned with the corresponding perforations pre-formed in the side walls to mount the inner wall to the side walls of the processing chamber. To reposition the inner wall (once the plurality of fasteners have been removed), it is typically necessary for a first operator to hold the relatively large inner wall in the desired position while a second operator replaces the plurality of fasteners in the corresponding perforations in the side walls.

Consequently, installing, servicing and repositioning the inner wall of the processing chamber is time consuming and requires considerable dexterity and skill. In wet processing operations that involve textile fabrics in cloth rope form having great variations in weight, texture, thickness, flexibility and load, the time required to reposition the inner wall to accommodate a different textile fabric may result in significant loss of production. Accordingly, the efficiency of the wet processing operation is greatly reduced, and the cost of processing the textile fabrics is greatly increased.

Further, each of the plurality of fasteners disclosed in the Hacker et al. patent consists of: (1) a hex head bolt having a threaded portion adjacent the end opposite the hex head; (2) an internally threaded nut for engaging the threaded portion of the hex head bolt; and (3) a cup-shaped bracket that engages the C-shaped lateral flanges of the inner wall when the nut is tightened on the bolt. Because each of the plurality of fasteners includes at least three small, separate pieces which must be removed and replaced, it is highly possible that at least one of the pieces of a fastener may loosen during operation of the wet processing machine and cause damage to the machine or to the interior of the processing chamber. If a cloth rope is subsequently circulated through the processing chamber, the expensive textile fabric could be irreparably damaged by the piece of the fastener inside the chamber. In addition, the loose piece of the fastener may damage the finish on an interior surface of the processing chamber. As a result, the textile fabric may be torn, ripped or damaged as it rotates through the processing chamber.

It is apparent that the known textile wet processing machines do not adequately accommodate different textile fabrics having great variations in weight, texture, thickness, flexibility and load. Accordingly, it is clear that a textile wet processing machine including a processing chamber having an adjustable inner wall to change the volumetric size of the processing chamber is needed wherein: (1) the inner wall is selectively adjustable to any position between a predetermined innermost position and a predetermined outermost position; (2) the inner wall may be quickly and easily repositioned; and (3) the means for adjusting the inner wall does not include small, separate pieces that may loosen during operation of the wet processing machine and cause damage to the machine or to the interior of the processing chamber.

Accordingly, it is a principle object of the present invention to provide a textile wet processing machine including a processing chamber having an adjustable inner wall that is selectively adjustable to any position between a predetermined innermost position and a predetermined outermost position.

It is a further object of the invention to provide a textile wet processing machine including a processing chamber having an adjustable inner wall that may be quickly and easily repositioned so that adjustment of the inner wall to a new position is not time consuming and does not require considerable dexterity.

It is a further object of the invention to provide a textile wet processing machine including a processing chamber having an adjustable inner wall and a means for adjusting the inner wall that does not include small, separate pieces that may loosen during operation of the wet processing machine and cause damage to the machine or to the interior of the processing chamber.

SUMMARY OF THE INVENTION

The invention is a textile wet processing machine including a processing chamber having an adjustable inner wall to accommodate textile fabrics in cloth rope form having great variations in weight, texture, thickness, flexibility and load. The inner wall is adjustable to any position between a predetermined innermost position and a predetermined outermost position relative to the outer wall. Thus, the processing chamber of the textile wet processing machine of the invention may be adjusted to differing volumetric sizes to enable the machine to realize its maximum capacity for treating a particular textile fabric.

The present invention is a textile wet processing machine for treating textile fabric in continuous cloth rope form. The machine includes a generally hollow vessel, a generally hollow processing chamber positioned within the vessel for receiving the textile fabric therein, means for introducing a treatment liquid, such as liquid dye solution, into the vessel, circulation means for circulating the textile fabric through the processing chamber, means for returning the treatment liquid from the processing chamber to the vessel, and pumping means for pumping the treatment liquid back into the vessel and the processing chamber. The circulation means for circulating the textile fabric is preferably located near the top of the vessel, and is provided for drawing the cloth rope from the outlet of the processing chamber and returning it to the inlet of the processing chamber so that the cloth rope is repeatedly circulated through the processing chamber.

The processing chamber includes a pair of opposed side walls, an outer wall extending transversely between the pair of opposed side walls, and an inner wall extending transversely between the pair of opposed side walls opposite the outer wall. Preferably, the means for returning the treatment liquid from the processing chamber is a plurality of perforations that are formed in the pair of opposed side walls, the outer wall, or the inner wall. The processing chamber further includes adjustment means for positioning at least a portion of the inner wall at any position between a predetermined innermost position and a predetermined outermost position. Thus, the position of the portion of the inner wall relative to the outer wall is adjustable.

In a preferred embodiment, the adjustment means includes a rack and pinion assembly. The rack and pinion assembly consists of a rack and a pinion. One of the rack and the pinion is movable relative to the outer wall of the processing chamber. The rack preferably includes a plurality of teeth spaced apart by a plurality of grooves formed in the rack between adjacent pairs of the plurality of teeth. The pinion preferably includes a thin disc having a plurality of circumferentially spaced apart ridges for engaging the plurality of grooves formed in the rack between adjacent pairs of the plurality of teeth.

An elongate, rigid connecting rod extends outwardly from the one of the rack and pinion that is movable relative to the outer wall. One end of the connecting rod is rotatably secured to the one of the rack and pinion that is movable relative to the outer wall. The other end of the connecting rod is secured to the portion of the inner wall which is adjustable relative to the outer wall. Preferably, a pivot rotatably secures the portion of the inner wall to at least one of the pair of opposed side walls. Preferably, a locking mechanism is provided for releasably locking the inner wall in the desired position under the force of the cloth rope as it is circulated through the processing chamber.

In an alternative embodiment, the adjustment means of the processing chamber includes a transverse shaft that is rotatably secured to at least one of the pair of opposed side walls, and a linkage assembly consisting of a first rigid link and a second rigid link. The first rigid link is fixed to and extends outwardly from the transverse shaft. Thus, the first rigid link is likewise rotatable relative to at least one of the pair of opposed side walls. The second rigid link is rotatably secured to the first rigid link by a first pivot, and is secured to the portion of the inner wall. Preferably, the adjustment means further includes a means for rotating the transverse shaft and the first rigid link of the linkage assembly together, and a second pivot for rotatably securing the portion of the inner wall to at least one of the pair of opposed side walls of the processing chamber. Preferably, a locking mechanism is provided for releasably locking the inner wall in the desired position under the force of the cloth rope as it is circulated through the processing chamber.

Accordingly, the present invention provides a textile wet processing machine including a processing chamber having an adjustable inner wall that is selectively adjustable to any position between a predetermined innermost position and a predetermined outermost position. Thus, the machine is able to realize its maximum capacity for treating different textile fabrics having great variations in weight, texture, thickness, flexibility and load. The adjustment means of the processing chamber permits the inner wall to be quickly and easily repositioned so that adjustment of the inner wall to a new position is not time consuming and does not require considerable dexterity. Further, the adjustment means of the processing chamber does not include small, separate pieces that may loosen during operation of the machine and cause damage to the machine or to the interior of the processing chamber.

BRIEF DESCRIPTION OF THE DRAWINGS

The foregoing and other objects will become more readily apparent by referring to the following detailed description and the appended drawings in which:

FIG. 1 is a side view of a preferred embodiment of the processing chamber of a textile wet processing machine according to the invention;

FIG. 2 is a top view of the processing chamber of FIG. 1;

FIG. 3 is a detail view of the adjustment means of the processing chamber of FIG. 1;

FIG. 3*a* is a partial end view of the adjustment means of FIG. 3 taken along line 3*a*—3*a;*

DETAILED DESCRIPTION OF THE PREFERRED EMBODIMENTS

Figure 6:
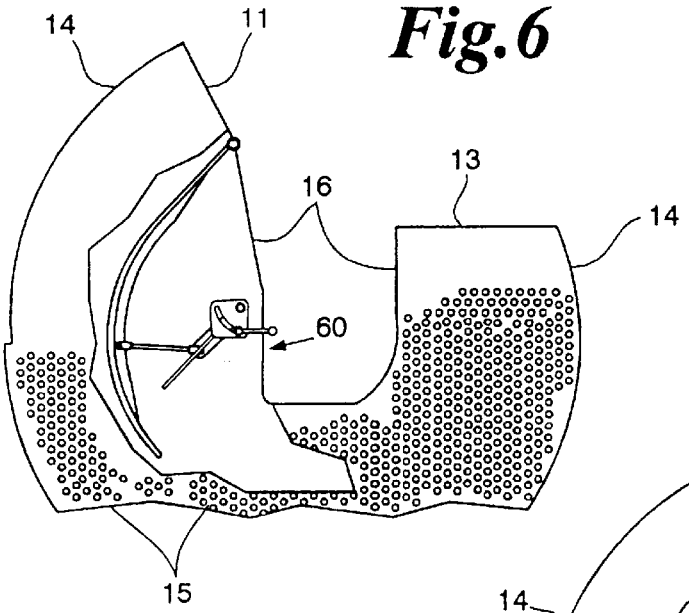
FIG. 6 is a side view of the processing chamber of FIG. 4 illustrating the inner wall of the processing chamber at the predetermined outermost position.

The invention is preferably embodied in a machine for wet processing textile fabrics in cloth rope form. Such a machine is known as a "textile wet processing machine," and the use of such a machine for dyeing textile fabrics in continuous cloth rope form is well understood by those skilled in the art. A more detailed description of a textile wet processing machine is provided in U.S. Pat. No. 5,014,526 issued May 14, 1991, to Hacker et al. The disclosure of the Hacker et al. patent is expressly incorporated herein to the extent that it describes the components of a textile wet processing machine other than the processing chamber.

The present invention is more specifically directed to the processing chamber of a textile wet processing machine. In particular, the invention is a textile wet processing machine comprising a processing chamber having an adjustable inner wall to accommodate textile fabrics in cloth rope form having great variations in weight, texture, thickness, flexibility and load. The inner wall may be quickly and easily positioned at any position between a predetermined innermost position and a predetermined outermost position relative to the outer wall of the processing chamber. Because the volumetric size of the processing chamber is changed by an adjustment of the position of the inner wall relative to the outer wall, the processing chamber enables the textile wet processing machine to realize its maximum capacity for treating a particular textile fabric.

Briefly, a conventional textile wet processing machine comprises a closed, generally hollow pressure vessel utilized to treat textile fabrics in cloth rope form with a treatment liquid, such as a liquid dye solution. A processing chamber, as will be described in detail hereinafter, is positioned within the interior of the vessel. The machine further comprises means for introducing a treatment liquid, such as liquid dye solution, into the vessel, circulation means for circulating the textile fabric through the processing chamber, means for returning the treatment liquid from the processing chamber to the vessel, and pumping means for pumping the treatment liquid back to the vessel and the processing chamber. The circulation means for circulating the textile fabric is preferably located near the top of the vessel, and is provided for drawing the cloth rope from the outlet of the processing chamber and returning it to the inlet of the processing chamber so that the cloth rope is repeatedly circulated through the processing chamber.

Referring now to the accompanying drawings, a processing chamber, indicated generally at 10, according to the invention is illustrated. As shown, the processing chamber 10 is generally hollow, U-shaped, and has an inlet end 11 which receives the cloth rope from the circulation means of the textile wet processing machine, and an outlet end 13 which returns the cloth rope to the circulation means of the textile wet processing machine. The processing chamber 10 comprises a pair of opposed side walls 12, an outer wall 14 that extends transversely between the pair of opposed side walls 12, and an inner wall 16 that extends transversely between the pair of opposed side walls opposite the outer wall. The opposed side walls 12, the outer wall 14 and the inner wall 16 may each include a plurality of perforations 15 in a predetermined pattern to return the treatment liquid to the returning means of the textile wet processing machine.

Figure 5:
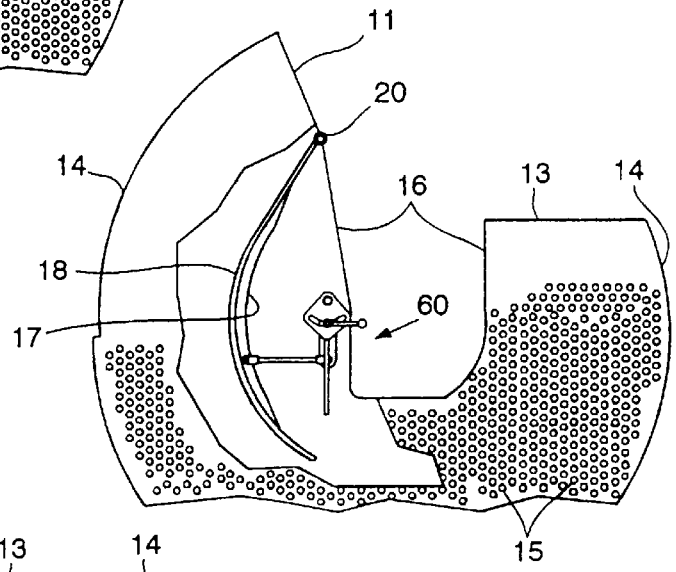
FIG. 5 is a side view of the processing chamber of FIG. 4 illustrating the inner wall of the processing chamber at a position between the predetermined innermost position and a predetermined outermost position.
Figure 4:
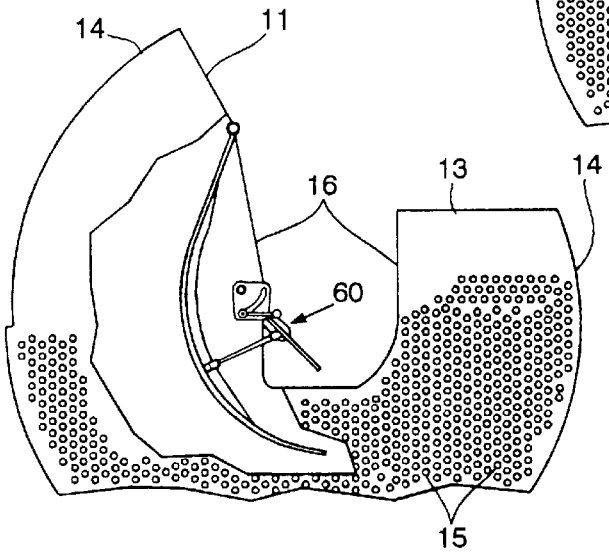
FIG. 4 is a side view of an alternative embodiment of the processing chamber of a textile wet processing machine according to the invention illustrating the inner wall of the processing chamber at a predetermined innermost position.

The inner wall 16 may be formed in one section, but preferably is formed in more than one section as will be described. Regardless, at least a portion of the inner wall 16 is adjustable relative to the outer wall 14. For example, the inner wall 16 may be formed of a first moveable section, preferably adjacent the inlet end 11 of the processing chamber 10, and a second fixed section, preferably adjacent the outlet end 13 of the processing chamber. In the preferred embodiments illustrated in the accompanying drawings, the inner wall 16 comprises a baffle 18 that is rotatable about a transverse axis 19 (FIG. 2). As shown, a pivot 20 (FIG. 1 and FIG. 5) may be provided for rotatably securing the baffle 18 to at least one of the pair of opposed side walls 12. Preferably, the baffle 18 is stiffened against bending under the force of the textile fabric as it is circulated through the processing chamber 10 by one or more stiffeners 17.

In the preferred embodiment illustrated in FIGS. 1–3*a,* the processing chamber 10 further comprises an adjustment means 30 for adjusting the position of the inner wall 16 relative to the outer wall 14. As indicated by the dashed lines in FIG. 1, the adjustment means 30 permits the position of the baffle 18 to be adjusted to any position between a predetermined innermost position and a predetermined outermost position. Repositioning the baffle 18 changes the volumetric size of the processing chamber 10. The differing volumetric sizes of the processing chamber 10 enable the textile wet processing machine to accommodate textile fabrics in cloth rope form having great variations in weight, texture, thickness, flexibility and load.

The adjustment means 30 illustrated herein comprises a rack and pinion assembly 32 comprising rack 31 and pinion 33. In operation, one of the rack 31 and the pinion 33 is linearly movable relative to the outer wall 14, and the other of the rack 31 and the pinion 33 is fixed relative the outer wall 14. In the preferred embodiment illustrated herein, the rack 31 is fixed relative to the outer wall 14 and the pinion 33 is linearly movable relative to the outer wall 14. As best shown in FIG. 1, the rack and pinion assembly 32 is preferably fixed to at least one of the pair of opposed side walls 12 of the processing chamber 10. Alternatively, the rack and pinion assembly 32 may be supported on an independent stand, or may be supported by a side wall of the vessel so that the transverse shaft 39 (FIG. 2 and FIG. 3*a*) of the pinion 33 extends through a plurality of processing chambers 10 positioned within the vessel.

The rack 31 of the rack and pinion assembly 32 preferably comprises a plurality of transverse teeth 34 which are spaced apart by a plurality of transverse grooves 35 formed in the rack between adjacent pairs of the plurality of teeth 34. The pinion 33 of the rack and pinion assembly 32 preferably comprises a thin disc 36 (FIG. 3*a*). The disc 36 comprises a plurality of circumferential, transverse ridges 37 which are spaced apart by a plurality of circumferential, transverse grooves 38 formed in the pinion 33 between adjacent pairs of the plurality of ridges 37. The ridges 37 of the pinion 33 are received in the grooves 35 formed in the rack 31, and the teeth 34 of the rack are received in the grooves 38 formed in the pinion 33 in a well known manner. Thus, in the preferred embodiment illustrated herein, the pinion 33 is linearly movable relative to the outer wall 14.

Adjustment means 30 further comprises an elongate, rigid connecting rod 40 that extends outwardly from the pinion 33. One end of the connecting rod 40 is rotatably secured to the transverse shaft 39 of the pinion 33. The other end of the connecting rod 40 is secured to the baffle 18 of the inner wall 16 at a medial location. Because the pinion 33 is linearly movable relative to the outer wall 14 on the rack 31, and one end of the connecting rod 40 is rotatably secured to the pinion while the other end of the connecting rod is secured to the baffle 18, the position of the baffle relative to the outer wall is adjustable between the predetermined innermost position and the predetermined outermost position indicated by the dashed lines in FIG. 1. The operator need only turn the handle 41 provided on the pinion 33 to move the pinion 33 linearly along the rack 31 to reposition the baffle 18 relative to he outer wall 14.

Preferably, the adjustment means 30 further comprises a releasable locking mechanism 42 to prevent further movement of the pinion 33 along the rack 31 in the direction away from the outer wall 14 under the force of the cloth rope as it circulates through the processing chamber 10. Thus, the adjustable portion of the inner wall 16 (i.e., baffle 18) will not move relative to the outer wall 14 during operation and change the volumetric size of the processing chamber. As best shown in FIG. 3*a,* the locking mechanism 42 preferably comprises a locking link 44 which is linearly movable along the rack 31. The locking link 44 comprises a rounded, transverse locking pin 46 that is received in the grooves 35 formed in the rack 31 between adjacent pairs of the plurality of teeth 34. Thus, the locking link 44 may be moved linearly along the rack 31 and positioned in the groove 35 immediately behind the pinion 33 to releasably lock the pinion against further movement in the direction away from the outer wall 14. By design, a linear movement of the locking mechanism 42 between adjacent grooves 35 of the rack 31 corresponds to a rotational movement of the baffle 18 equal to one degree of rotation of the inner wall 16 about the transverse axis 19. Thus, the locking mechanism 42 permits adjustment of the inner wall 16 relative to the outer wall 14 in increments as small as one degree of rotation about the transverse axis 19. For finer adjustments, the entire rack and pinion assembly 32 may be made linearly adjustable relative to the pair of opposed side walls 12 of the processing chamber 10.

As best shown in FIG. 3, the rack and pinion assembly 32 may be provided with elongate slots 48. The slots 48 permit the entire rack and pinion assembly 32 to be moved linearly relative to the side walls 12 of the processing chamber 10 a distance at least as great as the linear distance between adjacent grooves 35 of the rack 31. Accordingly, the baffle 18 of the inner wall 16 may be positioned at any position between the predetermined innermost position and the predetermined outermost position indicated by the dashed lines in FIG. 1 by a combination of gross and fine adjustments. Gross adjustments may be accomplished first by linear movement of the pinion 33 along the rack 31, and then fine adjustments may be accomplished by linear movement of the entire rack and pinion assembly 32 within the slots 48.

In the alternative embodiment illustrated in FIGS. 4–7, the processing chamber 10 is as previously described, and like reference numerals indicate like parts of the processing chamber. However, the adjustment means 30 of the previously described embodiment of the invention is replaced by the adjustment means 60 of the alternative embodiment. Like the adjustment means 30, the adjustment means 60 permits the baffle 18 of the inner wall 16 to be positioned at any position between a predetermined innermost position (illustrated in FIG. 4) and a predetermined outermost position (illustrated in FIG. 6) relative to the outer wall 14.

Figure 7:
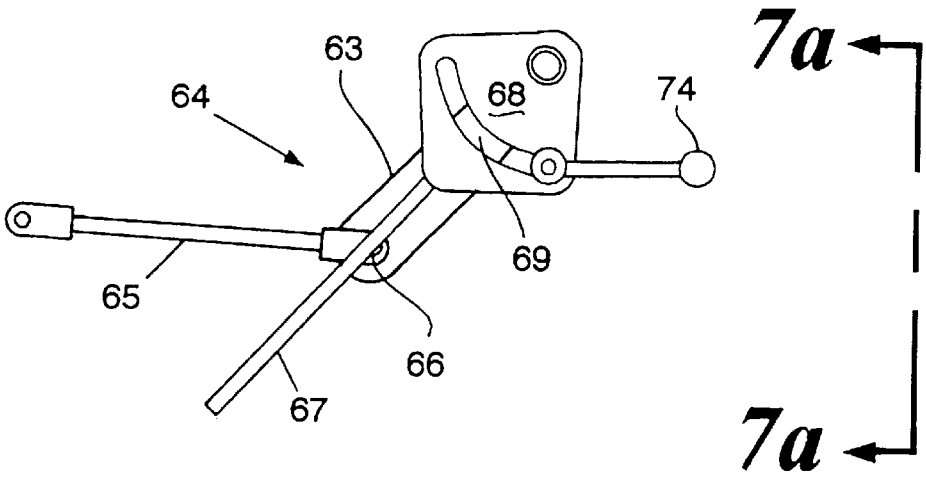
FIG. 7 is a detail view of the adjustment means of the processing chamber of FIG. 4.
Figure 7A:
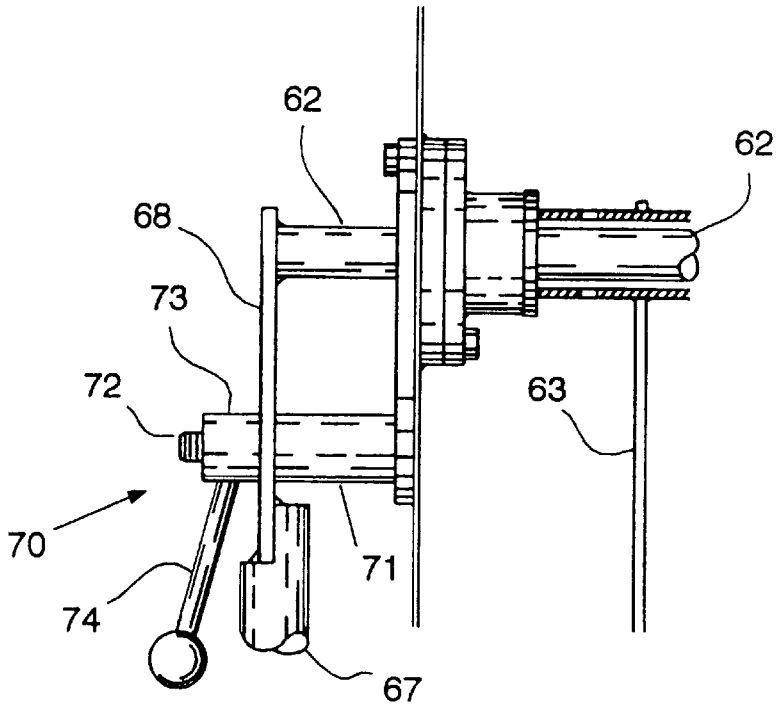
FIG. 7*a* is a partial end view of the adjustment means of FIG. 7 taken along line 7*a*—7*a*.

As best shown in FIG. 7*a,* adjustment means 60 preferably comprises a transverse shaft 62 that is rotatably secured to at least one of the pair of opposed side walls 12. Alternatively, the transverse shaft 62 may be supported on an independent stand, or may be supported by a side wall of the vessel so that the shaft 62 extends through a plurality of processing chambers 10 positioned within the vessel. The adjustment means 60 further comprises a linkage assembly 64 (FIG. 7). The linkage assembly 64 preferably comprises a first rigid link 63 that is fixed to and extends outwardly from the transverse shaft 62, and a second rigid link 65 that is rotatably secured to the free end of the first rigid link at one end by a pivot 66. The other end of the second rigid link 65 is secured to the baffle 18 of the inner wall 16.

The adjustment means 60 further comprises a mounting plate 68 that is fixed, such as by welding, to the rotatable transverse shaft 62. An elongate adjustment handle 67 is fixed to and extends outwardly from the mounting plate 68. Movement of the adjustment handle 67 results in rotation of the transverse shaft 62, and thus the first rigid link 63. Consequently, the second rigid link 65 causes the baffle 18 of the inner wall 16 to rotate about the transverse axis 19. Thus, the position of the baffle 18 relative to the outer wall 14 is adjustable to any position between the predetermined innermost position and the predetermined outermost position illustrated in FIGS. 4–6.

Preferably, the adjustment means 60 further comprises a releasable locking mechanism 70 to prevent further rotational movement of the handle 67 (and thus mounting plate 68) about the axis of the transverse shaft 62 under the force of the cloth rope as it circulates through the processing chamber 10. Thus, the adjustable portion of the inner wall 16 (i.e., baffle 18) will not move relative to the outer wall 14 during operation and change the volumetric size of the processing chamber.

As best shown in FIG. 7*a,* the locking mechanism 70 preferably comprises a first locking spacer 71 that is fixed to the side wall 12, and an externally threaded post 72 that is threaded securely into the first locking spacer 71 and extends outwardly therefrom. A second locking spacer 73 is internally threaded to engage the external threads on the exposed portion of the post 72. When the second locking spacer 73 is threaded onto the post 72, the mounting plate 68 is clamped between the first locking spacer 71 and the second locking spacer. Thus, the locking mechanism 70 may be utilized to releasably lock the mounting plate 68 against further rotation about the axis of the transverse shaft 62. A handle 74 may be provided to assist threading the second locking spacer 73 onto the post 72.

A slot 69 is formed in the face of the mounting plate 68 to permit the handle 67 (and thus the mounting plate) to rotate freely about the axis of the transverse shaft 62. Accordingly, an operator of the machine can quickly and easily reposition the baffle 18 of the processing chamber 10 to any position between the predetermined innermost position and the predetermined outermost position by first releasing the locking mechanism 70, then moving the handle 67 to rotate the transverse shaft 62 so that the baffle 18 of the inner wall 16 moves to the desired position, and finally rotating the handle 74 to thread the second locking spacer 73 onto the post 72 to clamp the mounting plate 68 against the first locking spacer 71.

As is now apparent, the invention provides a textile wet processing machine comprising a processing chamber having an adjustable inner wall to accommodate textile fabrics in cloth rope form having great variations in weight, texture, thickness, flexibility and load. Accordingly, the volumetric size of the processing chamber may be changed to enable the wet processing machine to realize its maximum capacity for treating a particular textile fabric. It should be emphasized that the present invention provides a processing chamber having an adjustable inner wall that is quickly and easily repositioned so that the efficiency of the wet processing operation is not greatly reduced, and the cost of processing the textile fabrics is not greatly increased. In addition, the adjustment means of the invention disclosed herein does not include small, separate pieces that may loosen during operation of the wet processing machine and cause damage to the machine or to the interior of the processing chamber.

Obviously, many alternative embodiments and modifications of the invention are within the level of ordinary skill of those accomplished in the art of wet processing textile fabrics. Thus, it is to be understood that the invention is not intended to be limited to the preceding description of the preferred embodiments, or by the specific embodiments illustrated in the accompanying drawings. Rather, it is intended that the invention encompass all embodiments within the spirit and scope of the inventive concept disclosed herein.

That which is claimed is:

1. A hollow processing chamber for wet processing textile fabric in continuous cloth rope form, said chamber comprising:

a pair of opposed side walls;

an outer wall extending transversely between said pair of opposed side walls;

an inner wall extending transversely between said pair of opposed side walls opposite said outer wall; and adjustment means for positioning at least a portion of said inner wall at any position between a predetermined innermost position and a predetermined outermost position relative to said outer wall;

a rack and pinion assembly comprising a rack and a pinion, one of said rack and said pinion movable relative to said outer wall;

an elongate, rigid connecting rod extending outwardly from said one of said rack and said pinion, a first end of said connecting rod rotatably secured to said one of said rack and said pinion and a second end of said connecting rod secured to said portion of said inner wall.

2. A processing chamber according to claim 1 wherein said one of said rack and said pinion is movable relative to the other of said rack and said pinion; and wherein said adjustment means further comprises means for moving said one of said rack and said pinion relative to the other of said rack and said pinion.

3. A processing chamber according to claim 1 wherein said rack of said rack and pinion assembly comprises a plurality of teeth spaced apart by a plurality of grooves formed in said rack between adjacent pairs of said plurality of teeth; and wherein said pinion comprises a thin disc, said disc comprising a plurality of circumferentially spaced apart ridges for engaging said plurality of grooves formed in said rack between adjacent pairs of said plurality of teeth.

4. A processing chamber according to claim 1 wherein said portion of said inner wall is rotatable about a transverse axis and further comprising a pivot for rotatably securing said portion of said inner wall about the transverse axis.

5. A processing chamber according to claim 1 wherein said adjustment means further comprises locking means for releasably locking said portion of said inner wall at any position between said innermost position and said outermost position of said portion of said inner wall relative to said outer wall.

6. A processing chamber according to claim 1 wherein at least one of said pair of opposed side walls has a plurality of perforations therethrough.

7. A processing chamber according to claim 1 wherein said outer wall has a plurality of perforations therethrough.

8. A processing chamber according to claim 1 wherein said inner wall has a plurality of perforations therethrough.

9. A machine for wet processing textile fabric in continuous cloth rope form, said machine comprising:

a hollow vessel;

a hollow processing chamber positioned within said vessel for receiving the textile fabric therein, said processing chamber comprising a pair of opposed side walls;

an outer wall extending transversely between said pair of opposed side walls;

an inner wall extending transversely between said pair of opposed side walls opposite said outer wall; and adjustment means for positioning at least a portion of said inner wall at any position between a predetermined innermost position and a predetermined outermost position relative to said outer wall;

means for introducing a treatment liquid into said processing chamber, said adjustment means comprising a rack and pinion assembly comprising a rack and a pinion, one of said rack and said pinion movable relative to said outer wall, said rack comprising a plurality of teeth spaced apart by a plurality of grooves formed in said rack between adjacent pairs of said plurality of teeth, said pinion comprising a thin disc, said disc comprising a plurality of circumferentially spaced apart ridges for engaging said plurality of grooves formed in said rack between adjacent pairs of said plurality of teeth;

an elongate, rigid connecting rod extending outwardly from said one of said rack and said pinion, a first end of said connecting rod rotatable secured to said one of said rack and said pinion and a second end of said connecting rod secured to said portion of said inner wall; and a pivot for rotatable securing said portion of said inner wall about a transverse axis;

circulation means for circulating the textile fabric through said processing chamber;

means for returning the treatment liquid from said processing chamber to said vessel; and pumping means for pumping the treatment liquid back into the vessel and the processing chamber.

10. A machine according to claim 9 wherein said means for returning the treatment liquid from said processing chamber to said vessel comprises a plurality of perforations formed in at least one of said inner wall, said outer wall and said pair of opposed side walls.

* * * * *

UNITED STATES PATENT AND TRADEMARK OFFICE

CERTIFICATE OF CORRECTION

PATENT NO : 5,873,270
DATED : February 23, 1999
INVENTOR(S): Marc D. Scholl

It is certified that error appears in the above-identified patent and that said Letters Patent is hereby corrected as shown below:

In the Claims:

Column 12, line 3, delete "rotatable", insert --rotatably--.

Column 12, line 7, delete "rotatable", insert --rotatably--.

Signed and Sealed this

Fourteenth Day of September, 1999

*Attest:*

Q. TODD DICKINSON

*Attesting Officer*

*Acting Commissioner of Patents and Trademarks*